US006276684B1

(12) United States Patent
Hershkovits et al.

(10) Patent No.: US 6,276,684 B1
(45) Date of Patent: Aug. 21, 2001

(54) PUZZLE

(75) Inventors: Dan Hershkovits, Ramat Gan; Gil Druckman, Tel Aviv, both of (IL); Daniel Chaim Kishon, New Malden (GB)

(73) Assignee: Character Games Limited (GB)

( * ) Notice: Subject to any disclaimer, the term of this patent is extended or adjusted under 35 U.S.C. 154(b) by 0 days.

(21) Appl. No.: 09/627,681

(22) Filed: Jul. 28, 2000

Related U.S. Application Data

(63) Continuation of application No. PCT/GB99/00314, filed on Jan. 29, 1999.

(30) Foreign Application Priority Data

Jan. 30, 1998 (GB) ..... 9802144

(51) Int. Cl.[7] ..... A63F 9/08
(52) U.S. Cl. ..... 273/156; 273/157 R
(58) Field of Search ..... 273/156, 157 R, 273/155, 153 R, 160; 446/117

(56) References Cited

U.S. PATENT DOCUMENTS

| | | | | |
|---|---|---|---|---|
| 423,066 | * | 3/1890 | Massey | 446/117 |
| 702,615 | * | 6/1902 | Barden | 273/157 R |
| 2,493,697 | * | 1/1950 | Raczkowski | 273/157 R |
| 2,725,234 | * | 11/1955 | Coble et al. | 273/157 R |
| 3,564,757 | * | 2/1971 | Fields | 446/117 |
| 3,779,558 | * | 12/1973 | Moreau | 273/157 R |
| 4,509,920 | * | 4/1985 | Kaufmann | 446/117 |
| 4,820,234 | * | 4/1989 | Isaf | 446/117 |
| 5,145,177 | * | 9/1992 | Wells | 273/156 |
| 5,396,713 | | 3/1995 | Valdez . | |
| 5,683,086 | | 11/1997 | Druckman et al. . | |
| 5,700,177 | | 12/1997 | Lemelson . | |
| 5,806,853 | | 9/1998 | Druckman et al. . | |

FOREIGN PATENT DOCUMENTS

WO 97/27920 8/1997 (WO) .

* cited by examiner

*Primary Examiner*—Steven Wong
(74) *Attorney, Agent, or Firm*—Luedeka, Neely & Graham, P.C.

(57) ABSTRACT

The present invention relates to a puzzle comprising a plurality of planar elements (54, 55, 57) and a main core member (53). When the plurality of planar elements (54, 55, 57) are assembled in a correct order then the planar elements (54, 55, 57) together define a recognizable three-dimensional figure (50). In some aspects of the invention the planar elements (54, 55, 57) comprise at least first (54) and second (55, 57) sub-groups of planar elements. The first sub-group of planar elements (54) are for assembly on the main core member (53). The assembled three-dimensional figure comprises a plurality of separately identifiable components (56, 58). One of the components (56, 58) is defined totally by the second sub-group of planar elements (55, 57) and is an entity identifiable separately from the remainder of the assembled puzzle. In some embodiments the planar elements (55) of the second sub-group are mounted on a branch core member (51). The planar elements of the second sub-group can be mounted on a branch core member so that they are not parallel to the planar elements of the first sub-group.

14 Claims, 5 Drawing Sheets

PUZZLE

This application is a continuation of PCT/GB99/00314 Jan. 29, 1999.

The present invention relates to a puzzle.

Three-dimensional puzzles called Sculpture Puzzles have been produced by the applicant. Examples are shown in published patent applications of the applicant.

The present invention relates to improvements to three-dimensional puzzles.

The present invention provides a puzzle comprising:

a plurality of planar elements and a main core member wherein:

when the plurality of planar elements are assembled in a correct order then the planar elements together define a recognisable three-dimensional figure;

the plurality of planar elements comprise at least first and second sub-groups of planar elements, the first sub-group of planar elements are for assembly solely on the main core member and each of the first sub-group of planar elements has an aperture therethrough and the main core member in the assembled puzzle extends through the apertures in the planar elements of the first sub-group;

the assembled three-dimensional figure comprises a plurality of separately identifiable components;

one of the components is defined totally by the second sub-group of planar elements, the second sub-group of planar element when assembled together defining the shape of the said component;

the component defined by the second sub-group of planar elements is identifiable separately from the remainder of the assembled puzzle; and several of the second sub-group of planar elements have non-planar exterior surfaces which at least in part lie adjacent to and are surrounded by surfaces of several planar elements of the first sub-group of planar elements.

The present invention provides in a second aspect a puzzle comprising:

a plurality of planar elements each having an aperture therethrough;

a main core member; and a branch core member; wherein:

when the plurality of planar elements are assembled in a correct order on the main core member and the branch core member, with at least one of the main and branch core members extending through the aperture in each planar member, then the planar elements together define a recognisable three-dimensional figure;

the plurality of planar elements comprises at least first and second sub-groups of planar elements;

the planar elements of the first sub-group are parallel to each other in the completed puzzle;

the planar elements of the second sub-group are parallel to each other in the completed puzzle;

the planar elements of the first sub-group are not parallel to the planar elements of the sub-group in the completed puzzle.

The present invention provides in a third aspect a puzzle comprising:

a plurality of planar elements and a main core member wherein:

when the plurality of planar elements are assembled in a correct order then the planar elements together define a recognisable three-dimensional figure;

the plurality of planar elements comprise at least first and second sub-groups of planar elements;

the first sub-group of planar elements each have an aperture therethrough and in the assembled puzzle the main core member extends through the apertures in the planar elements of the first sub-group;

the planar elements of the first sub-group are of a first colour; and the planar elements of the second sub-group are of a second colour different to the first colour.

The present invention provides in a fourth aspect a puzzle comprising:

a plurality of planar elements and a main core member wherein:

when the plurality of planar elements are assembled in a correct order then the planar elements together define a recognisable three-dimensional figure;

the plurality of planar elements comprise at least first and second sub-groups of planar elements;

the first sub-group of planar elements each have an aperture therethrough and are all for assembly on the main core member, with the main core member extending through the apertures in the first sub-group of planar elements;

the planar elements of the first sub-group are of a first material; and the planar elements of the second sub-group are of a second material different to the first material.

In the fifth aspect of the present invention there is provided a puzzle comprising:

a plurality of planar elements; and a main core member; wherein:

when the plurality of planar elements are assembled in a correct order then the planar elements together define a recognisable three-dimensional figure, at least some of the planar elements each have an aperture therethrough and the main core member extends through the apertures in said planar elements in the assembled puzzle;

a sub-set of the planar elements each have a cut-out portion and the cut-out portions of the sub-set of planar elements together define in the assembled puzzle an externally facing socket, and the puzzle comprises a shaped component which matches in shape the defined socket and which in the assembled puzzle is located in the socket and is clearly identifiable as a component separate from the remainder of the assembled puzzle.

Preferred embodiments of the present invention will be described with reference to the accompanying drawings in which.

Figure 1:
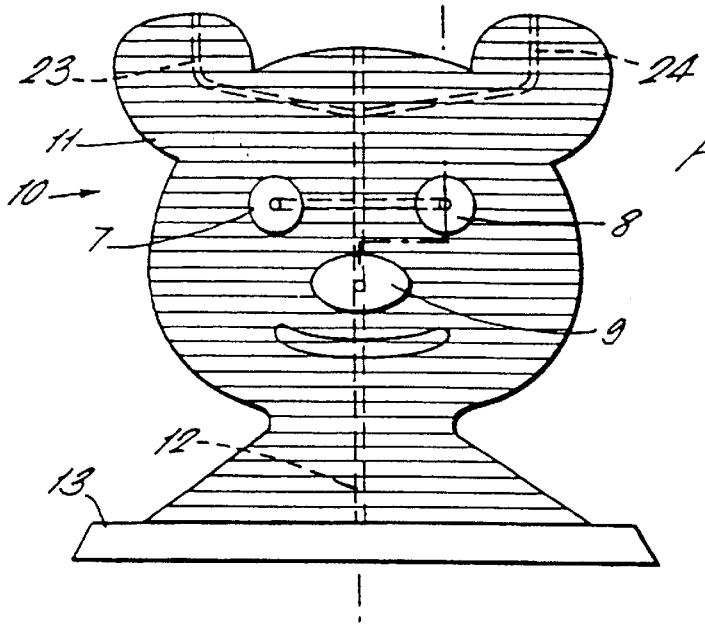
FIG. 1 is a schematic view of a first embodiment or puzzle according to the invention.

In FIG. 1 there can be seen a puzzle 10 which comprises a plurality of planar elements 11 which extend generally horizontally in use. The planar elements 11 are mounted on a branched core member 12 which extends upwardly from a base 13. Each of the planar elements 11 have at least one aperture through which the core 12 will pass in use. The planar elements have differing cross-sections and when the planar elements 11 are assembled in a correct order they together define a chosen three-dimensional shape, in FIG. 1 the chosen shape being the head of a teddy bear.

The assembly of three-dimensional shapes from a plurality of planar elements is known from the applicant's products and earlier published patent specifications.

Figure 3:
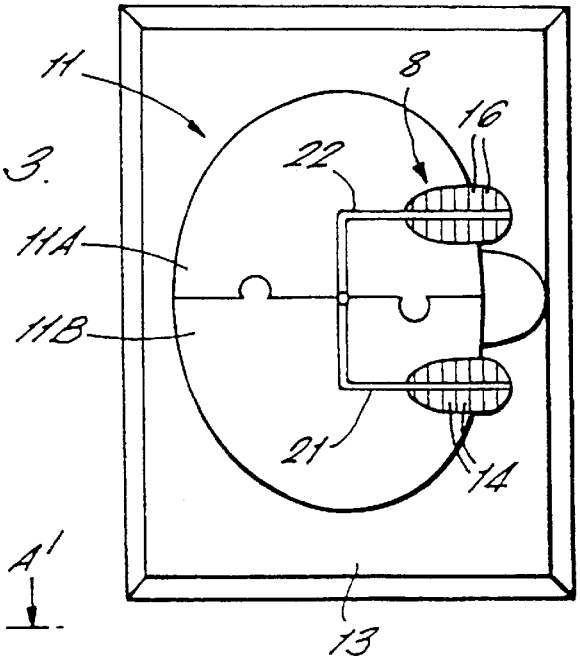
FIG. 3 is a cross-section through the puzzle of FIGS. 1 and 2, taken along the line A–A', in the direction of the arrows shown in FIG. 2.
Figure 2:
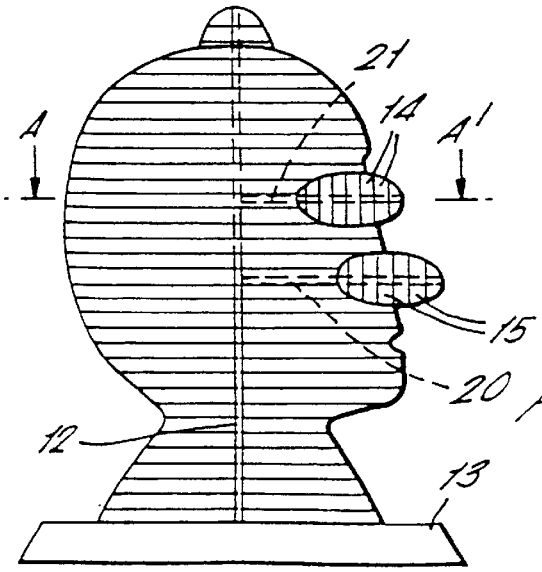
FIG. 2 is a cross-section through the puzzle of FIG. 1.

The present invention differs from the earlier puzzles in that the completed puzzle comprises a plurality of component parts, each part being formed from a sub-group of the total group of planar elements used to complete the puzzle. Thus, it can be seen in FIGS. 2 and 3 that the eyes 7 and 8 and nose 9 of the teddy bear are formed each from sub-groups of planar elements 14, 15 and 16. In FIG. 3 the cross-section shows the planar elements 16 together defining the eye 8 and the planar elements 15 together defining the eye 9.

The core 12 has five different branches 20–24. The branches 23 and 24 seen in dotted lines in FIG. 1 are used as the supports for the planar elements 11 which define the ears of the teddy bear; each of these planar elements will have an aperture therethrough of a shape and size to match the cross-section of one of the branches 23 and 24.

The branches 21 and 23 extend in a generally horizontal plane in use. The branches 21 and 23 are accommodated on matched grooves in two adjacent planar elements 11, the grooves together defining two bores, one each for the branches 21 and 24 when the relevant planar elements are brought together. A number of the planar elements 11 will also define two eye sockets, one for each of the eyes 7 and 8, the external peripheries of the planar elements 11 being shaped to provide the socket features. A sub-group of planar elements can be assembled sequentially in correct order on the part of branch 21 extending through a socket pre-formed by assembled planar elements 11. The planar elements 14 when assembled in correct order on the branch 21 form the eye 7. Each planar element 14 will have an aperture therethrough which matches in shade and cross-section the cross section of the branch 21. The end of the branch 21 is threaded and the outermost one of the planar elements 14 will have a matching thread so that the element can be threaded on the end of the branch 21 and thereby secure all of the planar elements 14 on the branch 21. In similar fashion, the branch 22 extends through a bore formed by matching grooves in adjacent planar elements 11 when they are brought into abutment with each other. The planar elements 16 will be mounted on the branch 22 (each element having an aperture therethrough which matches in shape and cross-section the cross-section of branch 22) in an eye socket defined by the exterior surface of a plurality of the planar elements 11. The planar elements 16 when assembled in correct order will define the eye 8. The free end of the branch 22 is threaded and the outermost planar element 16 has a matching thread whereby the outermost planar element 16 can be used to secure the other elements 16 on the branch 22 in position in the eye socket.

The branch 20 extends through a bore formed by matching grooves in adjacent abutting planar elements 11. A socket is defined on the exterior of the assembled teddy bear head for receiving the nose 9. The socket is defined by the exterior shape of a plurality of planar elements 11 when assembled together on the core 12. The plurality of planar elements 15 can be assemble on the branch 20 in a pre-formed socket in correct order to provide the nose 9. The end of the branch 20 is threaded and the outermost planar element 15 is also threaded so that the elements 15 can be secured on the branch 20.

It will be understood from the above description that the finished puzzle 10 comprises a number of different component parts; namely, the two eyes 7 and 8, the nose 9 and the remainder of the head. Each component is formed from a separate sub-group of planar elements; the nose 9 from planar elements 15, the eye from planar elements 15, the eye 8 from planar elements 6 and the rest of the head from the planar elements 11. The planar elements 11 are all parallel to each other in the finished puzzle. The planar elements 14 are all parallel to each other in the finished puzzle. However, the planar elements 14 are not parallel to the planar elements 11 in the finished puzzle. Indeed the planar elements 11 all lie on planes which are at right angles to the planes of the planar elements 11. In a similar fashion the planar elements 15 are parallel with each other but not parallel with the planar elements 11 and the planar elements 16 are parallel with each other but not parallel with the planar elements 11.

Each sub-group of the planar elements are preferably of different colours. For instance, the planar elements 11 could be brown, the planar elements 14 and 16 could be blue and the planar elements 15 could be red. This leads away from accepted practice since in general the prior art puzzles have all been made of pieces of the same colour.

Each sub-group of the planar elements can be of different materials. For instance, the planar elements 11 could all be of cardboard, whilst the planar elements 14, 15 and 16 could be of plastic material. In this case the planar elements 15 would be made by a first manufacturing process and the planar elements 14, 15 and 16 by a second different manufacturing process.

The planar elements 11 could each be a single unitary piece. In this case, the branches 20–24 will be detachable from the central core member 12 and planar elements slid down the main trunk of core 12 and then branches added on when necessary (the branches 20–24 could be push-fit or screw threaded). Alternatively, as shown in FIG. 3, at least some of the planar elements 11 could be formed of at least two pieces 11A and 11B, to be joined together in the manner of jigsaw pieces. In this case the core 12 and branches 20–24 could be formed as a single member and the planar elements 11 assembled from their constituent parts around the core 12 and branches 20–24.

Figure 4:
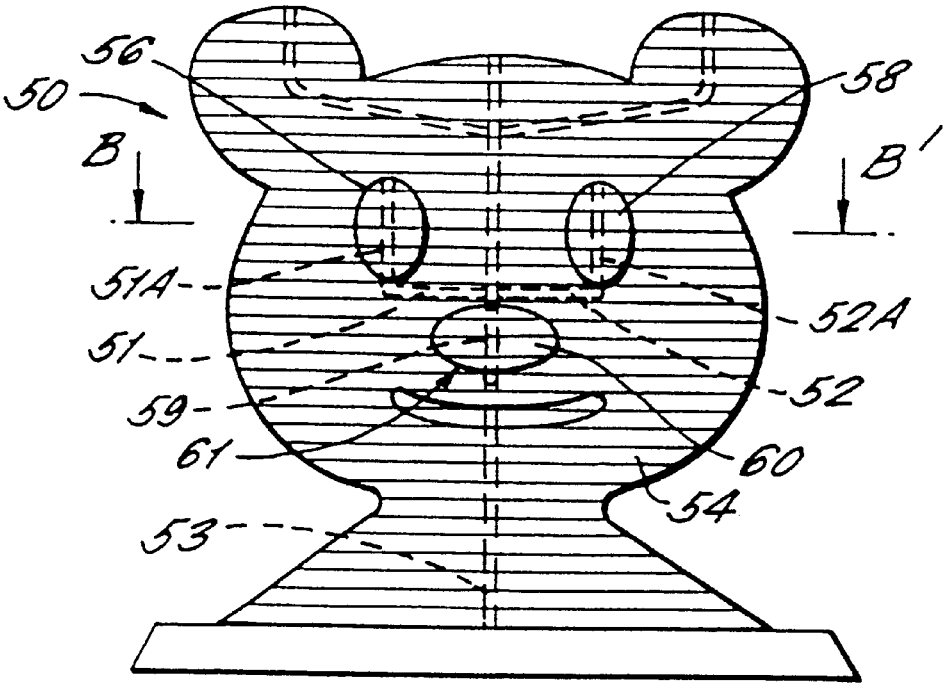
FIG. 4 is a schematic view of a second embodiment of puzzle according to the invention.
Figure 5:
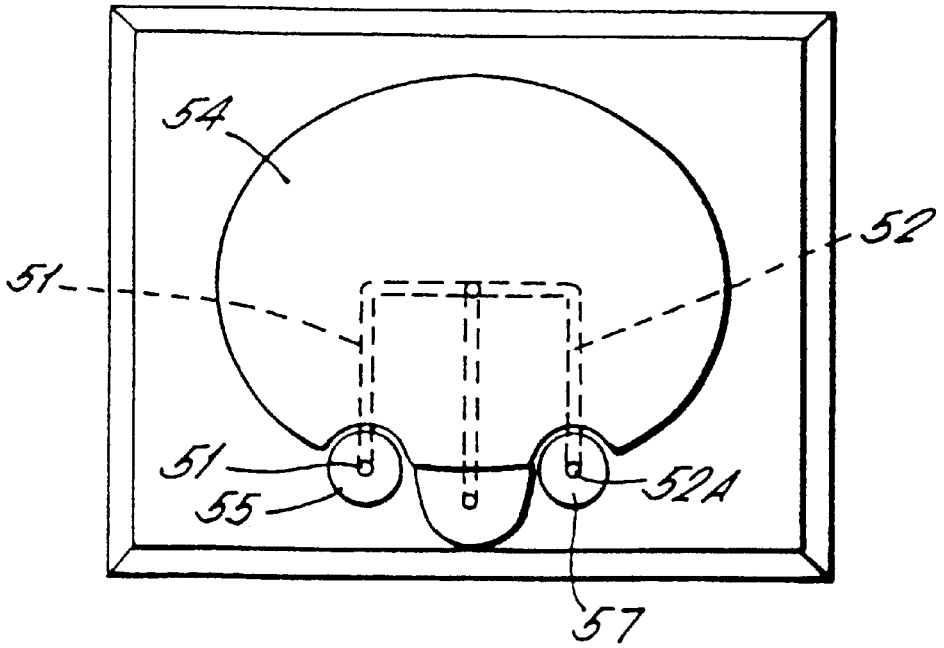
FIG. 5 is a cross-section through the puzzle of FIG. 4 taken along the line B–B' in the direction or the arrows shown in FIG. 4.
Figure 6:
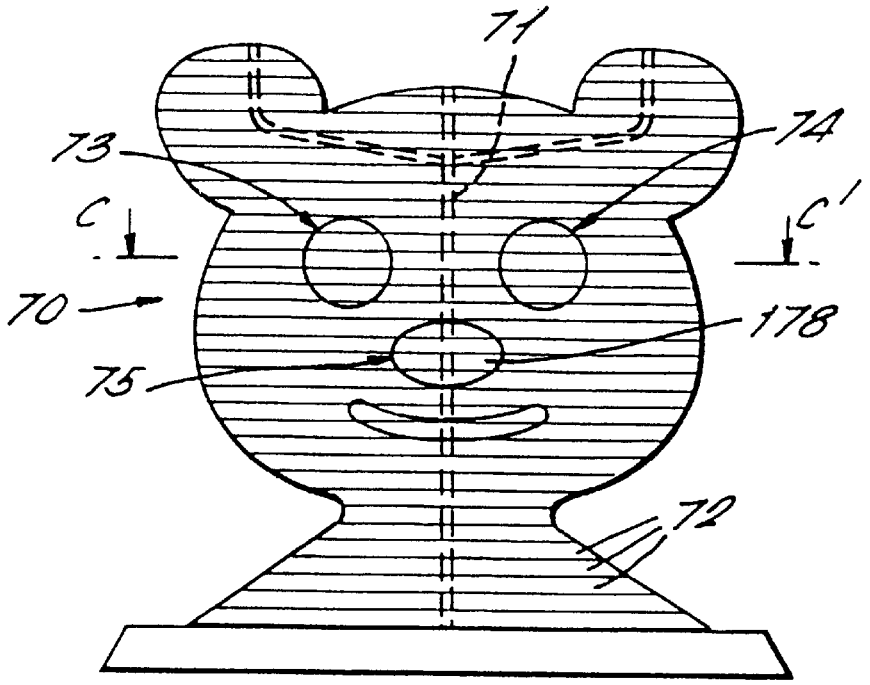
FIG. 6 is a schematic view of a third embodiment of puzzle according to the invention.

In a second embodiment of the invention, illustrated in FIGS. 4 and 5, a puzzle is again assembled to form a teddy bear's head. The puzzle of FIG. 5 is also formed (as with the puzzle of FIGS. 1 and 2) of components each formed from a sub-group of planar elements, the sub-groups being preferably of varying colours and/or materials. However, unlike the puzzle of FIGS. 1 and 2, all of the planar elements in the second embodiment of puzzle are parallel or co-planar with one another.

Branches 51 and 52 which extend from a trunk of core 53 have portions which extend along axes parallel to and spaced apart from the axis of the trunk of core 53. In the illustrated embodiment the trunk of core 53 extends vertically in use and the branch 51 has a portion 51A which extends vertically and the branch 52 has a portion 52A which extends vertically.

The branches 51 and 52 are accommodated in bores formed by matched grooves in adjacent abutting planar elements 54 (mounted on the trunk of core member 53) and eye sockets are defined by the exterior surfaces of a number of the planar elements 54. The branch sections 51A and 52A extend vertically in the eye sockets. A first sub-group of planar elements 55 are assembled in correct order on section 51A to form an eye 56. A second sub-group of planar elements 57 are assembled in correct order on the section 52A to form an eye 58. In this case it will be necessary to partly form an eye socket, then form an eye and then complete the eye socket.

A branch 59 is also provided with a vertically extending portion on which a plurality of planar elements 60 are assembled to form a nose 61. The branch 59 will extend in a bore provided by matched grooves in adjacent abutting planar elements 54 and the nose 61 will be provided in a socket defined by the exterior of a number of the elements 54. Again, the socket for the nose should be partly formed and then the nose formed and then the socket completed.

The planar elements 55, 57, 60 and 54 are all parallel or co-planar with each other. However, the planar elements 55, 57, 60 are of materials and/or colours different to those of the planar elements 54.

Preferably the planar elements 55, 57 and 60 are made by a first manufacturing process and the planar elements 60 by a separate second manufacturing process.

Whilst above the main trunk core member 12 is vertical and supported by a base, the trunk core member 12 could extend at any angle supported by a base or indeed be unsupported (e.g. both ends of the trunk core member 12 could be threaded and the extreme planar elements similarly threaded to secure all intervening core members on the trunk core member 12).

Whilst above the branch core member 20–24, 51, 52 and 59 are shown connected directly to the trunk core member either permanently or detachably, the branch core members could be auxiliary core members supported only by one or more planar elements 11 and not directly attached in any way to the main trunk core member 12. For instance, successive planar elements 11 could be provided with apertures which align on assembly to define a closed bore which would receive and support a branch core member.

In a third embodiment of the invention, illustrated in FIGS. 6 to 9, a puzzle 70 is again assembled to form a head of a teddy bear. The puzzle 70 is again formed of components, the components being varying colours and/or materials. However, unlike the first and second embodiments the eyes and nose of the teddy bear head are not formed on branch core members branched Off from a main core member 71.

A sub-group of brown planar elements 72 form the main body of the head of the teddy bear. The planar elements 72 are all mounted on core members and each planar element has an aperture therethrough for accommodating a core member.

In a first variant of the third embodiment of the invention (FIG. 7) the eyes 73, 74 and nose 75 of the teddy bear are each independent and separately identifiable components of the teddy bear head. The eye 73 is formed of a sub-group of planar elements 76 all parallel to each other and parallel to the planar elements 72. The eye 74 is formed of a sub-group of planar elements 77 all parallel to each other and parallel to the planar elements 72. The nose 75 is also formed of a sub-group of planar elements 178 all parallel to each other and parallel to the planar elements 72.

Figure 7:
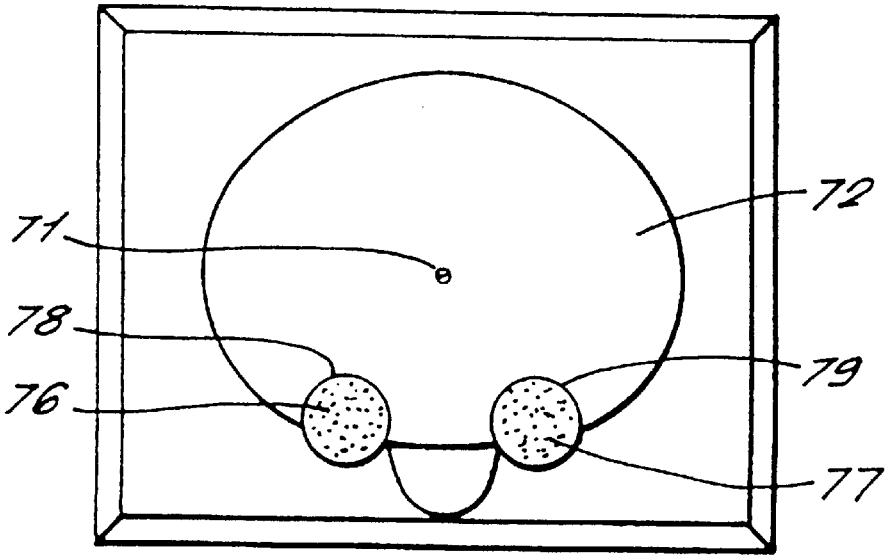
FIG. 7 is a cross-section through a first variant of the puzzle of FIG. 6 taken along the line C–C' in the direction of the arrows shown in FIG. 6.

None of the planar elements 76, 77 and 178 are mounted on core members. Instead, a plurality of the planar elements 72 are provided with peripheral cut-outs (e.g. 78, 79). Each cut-out (e.g. 78, 79) is shaped as illustrated in FIG. 7 to receive one of the planar elements 76, 77, 178 of the sub-groups of planar elements and to hold the received planar element in position. As the puzzle is built-up layer by layer, the planar elements 72 will be mounted one by one on the core member 71. As the planar elements 72 with cut-outs are mounted then a planar element of one of the subgroup of planar elements 76, 77, 178 will be mounted in each cut-out in each planar element 72 on mounting of the planar element 72 on the core 71. In this way, the planar elements 72 with cut-outs define sockets and the sub-groups of planar elements 76, 77, 178 form the eyes and nose of the teddy bear which are separately identifiable components of distinguishable colour or material firmly held in sockets defined by the planar elements 72. As illustrated in FIG. 7, the planar elements 76 and 77 are roughly circular and the illustrated planar element 72 has two cut-outs 78, 79 each of which has a surface which abuts and surrounds more than 180° of the outer circumferential surface or a planar element 76, 77 in order to engage and retain the planar element 76, 77 in position.

Figure 8:
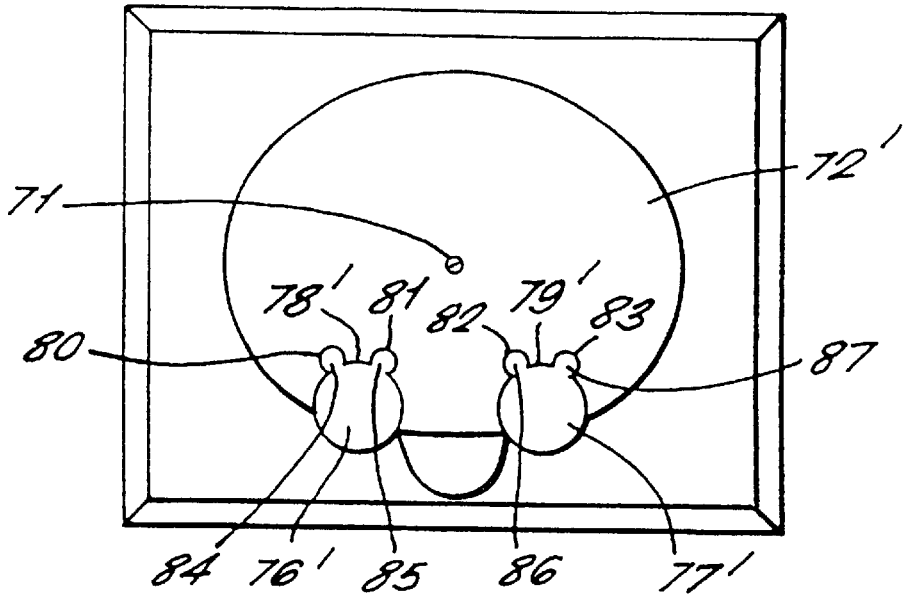
FIG. 8 is a cross-section through a second variant of the puzzle of FIG. 6 taken along the line C–C' in the direction of the arrows shown in FIG. 6.
Figure 9:
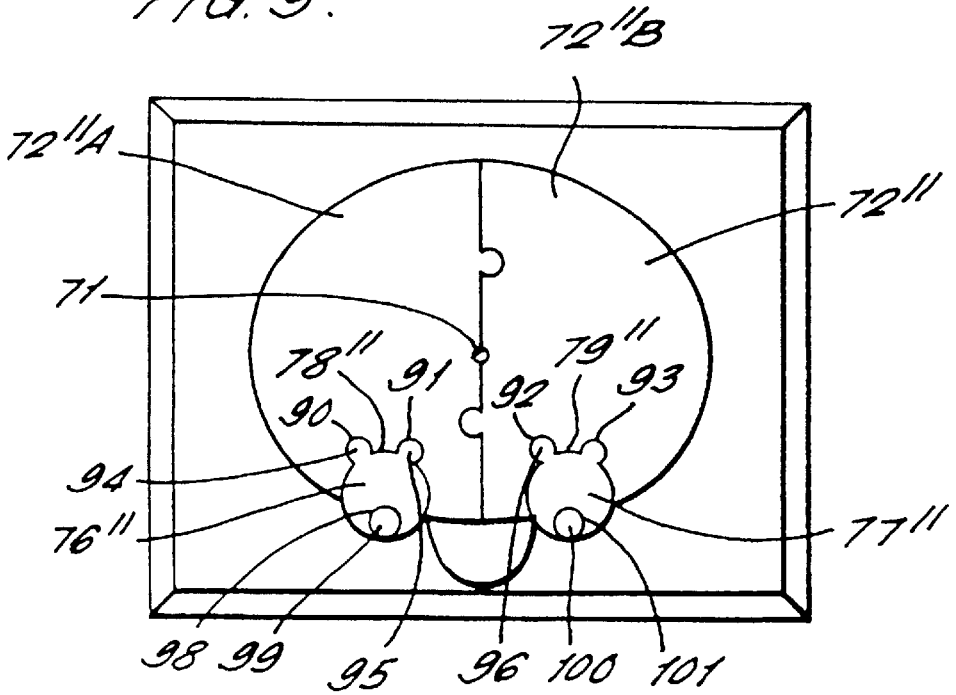
FIG. 9 is a cross-section through a third variant of the puzzle of FIG. 6 taken along the line C–C' in the direction of the arrows shown in FIG. 6.

In a second variant of the third embodiment of puzzle, illustrated in FIG. 8, the cut-outs 78' and 79' of the planar element 72' mounted on core 71 have themselves cut-outs 80,81,82 and 83 which receive respectively lugs 84 and 85 on the planar element 76' and lugs 86 and 87 of the planar element 77'. The interaction of lugs 84 and 85 with the cut-outs 80 and 81 holds the planar element 76' in place in the cut-out 78'. The interaction of the lugs 86 and 87 with cut-outs 82 and 83 holds the planar element 77' in place in the cut-out 79'.

In a third variant of the third embodiment of puzzle, the eyes 73 and 74 are more detailed in that they in themselves comprise two separately identifiable components, a white cornea and a black iris/pupil. Planar elements 76" and 77" define the white corneas of the eyes 73 and 74 and are held in place by interaction of lugs 94, 95 with cut-outs 90, 91 and interaction of lugs 96, 97 with cut-outs 92, 93, in the same manner as the FIG. 8 variant. However, the planar elements 76" which define the eye define a white cornea of the eye 73 and not the whole eye 73 and instead some of the planar elements 76" themselves have cut-outs 98 each of which receives a planar element 99 of a sub-group of planar elements 97 which together define a pupil/iris of eye 73. The cut-outs 98 in the planar elements 76" are shaped to securely retain the planar elements 99 in place.

In the puzzle of the third variant, at least some of the planar elements 72" mounted on core 71 are each formed of two puzzle pieces 72"A and 72"B with co-operating lugs and cut-outs. As the planar elements 72" are mounted one by one on the core member 71 then when the planar elements 72" with forward cut-outs 78" and 79" are mounted on the core member, then appropriate planar elements 76" and 77" must be selected and inserted in the cut-outs 78" and 79". Also, appropriate planar elements 99 and 100 must be inserted in cut-outs 98 and 101 in the planar elements 76" and 77". When the puzzle is assembled then brown-coloured planar elements 77" will form the majority of the teddy bear head, while a sub-group of white planar elements 76" will form a white cornea of an eye 73 of the teddy bear, the planar elements 76" being secured in a recess defined by the planar elements 72", and a sub-group of black planar elements 99 will form a black pupil of the eye 73, the planar elements 99 being secured in a cavity defined by the planar elements 76". In a similar way white planar elements 77" define a white cornea of the eye 74 and the black planar elements 100 define a black pupil of the eye 74.

Figure 10:
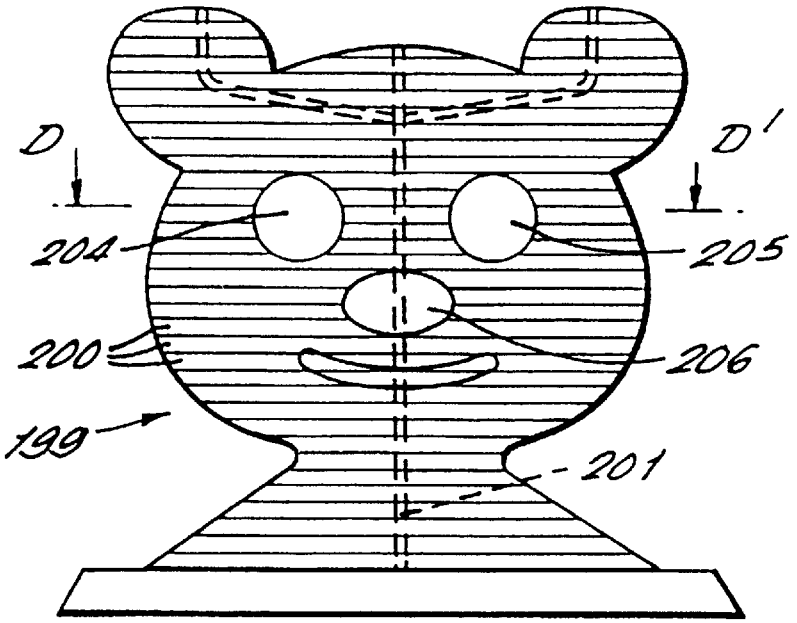
FIG. 10 is a schematic view of a fourth embodiment of puzzle according to the invention.
Figure 11:
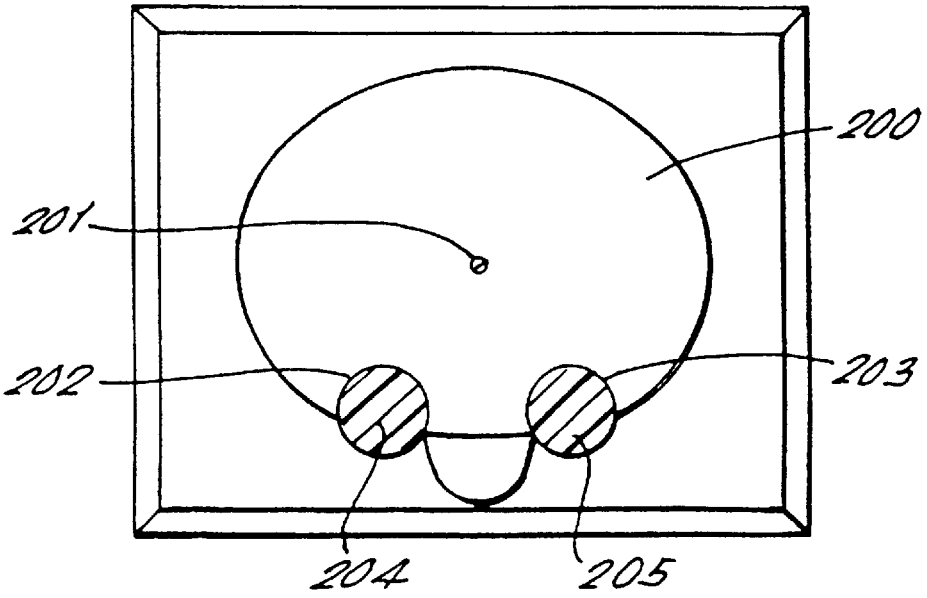
FIG. 11 is a cross-section through the fourth embodiment of puzzle taken along the line D–D' in the direction of the arrows shown in FIG. 10.

A fourth embodiment 199 of the puzzle is illustrated in FIGS. 10 and 11. In this embodiment the majority of a teddy bear head 199 is comprised of planar elements 200 mounted on a core member 201. The planar elements 200 are each made of cardboard. Some of the planar elements have peripheral cut-outs, e.g. the cut-outs 202 and 203 illustrated in FIG. 11. The puzzle 191 also has two eyes, 204, 205 and a nose 206. Each of these components is mounted in a recess defined by a plurality of the planar elements 200.

In FIG. 11 it can be seen that the cut-outs 202 and 203 each define part of sockets in which plastic eye components 204 and 205 are mounted and secured. The cut-outs in the planar elements 200 define in effect eye sockets in each of which a one-piece plastic eye 204, 205 is secured. In assembly of the puzzle, each eye socket should preferably be half-formed and then an eye inserted in the half-formed socket before the eye socket is completed by mounting of further planar elements 200. The nose 206 will in a similar fashion be located in a nose socket. The defined eye and nose sockets are shaped to firmly retain therein respectively one piece nose and the two one-piece eye components.

What is claimed is:

1. A puzzle comprising:

a plurality of planar elements and a main core member, wherein:

when the plurality of planar elements are assembled in a correct order then the planar elements together define a recognisable three-dimensional figure;

the plurality of planar elements comprise at least first and second sub-groups of planar elements;

the first sub-group of planar elements are for assembly on the main core member and each of the first sub-group of planar elements has an aperture therethrough and the main core member in the assembled puzzle extends through the apertures in the planar elements of the first sub-group;

the assembled three-dimensional figure comprises a plurality of separately identifiable components;

one of the components is defined totally by the second sub-group of planar elements, the second sub-group of planar elements when assembled together defining the shape of the said component;

the component defined by the second sub-group of planar elements is identifiable separately from the remainder of the assembled puzzle; and several of the second sub-group of planar elements have non-planar exterior surfaces which at least in part lie adjacent to and are surrounded by surfaces of several planar elements of the first sub-group of planar elements.

2. A puzzle as claimed in claim 1 comprising additionally a branch core member, wherein each of the second sub-group of planar elements has an aperture therethrough and the planar elements of the second sub-group are all for assembly solely on the branch core member, the branch core member in the assembled puzzle extending through the aperture in each of the planar elements of the second sub-group.

3. A puzzle as claimed in claim 1 wherein a sub-set of first sub-group of planar elements each have a cut-out portion and the sub-set of planar elements in the assembled puzzle together define a socket open to the exterior of the assembled puzzle, in which socket the second sub-group of planar elements are assembled to define the separately identifiable component, with planar elements of the second sub-group being assembled parallel to planar elements of the first sub-group and the second sub-group of planar elements partially overlaying and being supported by planar elements of the first sub-group of planar elements and the planar elements of the second sub-group extending out of the socket to be visible in the assembled puzzle.

4. A puzzle as claimed in claim 3 wherein the planar elements of the sub-set of the first sub-group have cut-out portions shaped to secure the planar elements of the second sub-group in the socket.

5. A puzzle as claimed in claim 4 wherein the planar elements of the second sub-group have lugs and/or cut-outs which match and engage lugs and/or cut-outs provided in the sub-set of the first group of planar elements.

6. A puzzle as claimed in claim 3 wherein a sub-set of second sub-group of planar elements each have a cut-out portion and together define in the assembled puzzle a socket open to the exterior of the assembled puzzle, in which socket a third sub-group of planar elements are assembled to define a second separately identifiable component, with planar elements of the third sub-group being assembled parallel to planar elements of the second sub-group with all the third sub-group of planar elements partially overlaying and being supported by planar elements of the second sub-group of planar elements and the planar elements of the third sub-group extending out of the socket defined by the second sub-group of planar elements to be visible in the assembled puzzle.

7. A puzzle as claimed in claim 1 wherein the planar elements of the second sub-group are of a colour different to the colour of the planar elements of the first sub-group.

8. A puzzle as claimed in claim 1 wherein the planar elements of the second sub-group are of a material different to the material of the plurality of planar elements of the first sub-group.

9. A puzzle as claimed in claim 2 wherein the planar elements of the first sub-group are all parallel to each other, all of the planar elements of the second sub-group are parallel to each other and the planar elements of the first sub-group are not parallel to the planar elements of the second sub-group.

10. A puzzle as claimed in claim 9 wherein the planes of the first sub-group of planar elements intersect with the planes of the second sub-group of planar elements at angles in the range of 30° to 90°.

11. A puzzle as claimed in claim 1 wherein the planar elements of the first sub-group are manufactured by a first manufacturing operation and the planar elements of the second sub-group are separately manufactured by a second manufacturing operation.

12. A puzzle as claimed in claim 1 wherein the planar elements of the first sub-group form the majority of the completed puzzle.

13. A method of assembly of a puzzle as claimed in claim 1 wherein planar elements of the first sub-group are mounted on the main core member and then planar elements of the second sub-group are mounted overlaying and supported by the mounted planar elements of the first subgroup and then more planar elements of the first sub-group are mounted on the main core member, the planar elements of the first sub-group at least partly surrounding the planar elements of the second sub-group in the completed puzzle.

14. A method of assembly of a puzzle as claimed in claim 1 wherein planar elements of the first sub-group are mounted on the main core member to define an externally facing socket, the second sub-group of planar elements are assembled within the said socket, the assembled planar elements of the second sub-group being partly visible in the assembled puzzle.

* * * * *